United States Patent [19]

Coughlin

[11] Patent Number: 4,892,068

[45] Date of Patent: Jan. 9, 1990

[54] GEARED AUTOMATIC COMPRESSION RELEASE FOR AN INTERNAL COMBUSTION ENGINE

[75] Inventor: Jeffrey P. Coughlin, Kaukauna, Wis.

[73] Assignee: Kohler Co., Kohler, Wis.

[21] Appl. No.: 364,745

[22] Filed: Jun. 9, 1989

[51] Int. Cl.[4] ..... F01L 13/08

[52] U.S. Cl. ..... 123/182; 123/90.16

[58] Field of Search ..... 123/90.16, 90.17, 182, 123/316

[56] References Cited

U.S. PATENT DOCUMENTS

| | | | |
|---|---|---|---|
| 2,259,983 | 10/1941 | Anderson | 123/182 |
| 2,850,002 | 9/1958 | Hovel | 123/182 |
| 3,314,408 | 4/1967 | Fenton | 123/90.17 |
| 3,362,390 | 1/1968 | Esty | 123/182 |
| 3,381,676 | 5/1968 | Campen | 123/182 |
| 3,395,689 | 8/1968 | Kruse | 123/182 |
| 3,496,922 | 2/1970 | Campen | 123/182 |
| 3,511,219 | 5/1970 | Esty | 123/182 |
| 3,620,203 | 11/1971 | Harkness | 123/182 |
| 3,897,768 | 8/1975 | Thiel | 123/182 |
| 3,901,199 | 8/1975 | Smith | 123/182 |
| 3,981,289 | 9/1976 | Harkness | 123/182 |
| 4,453,507 | 6/1984 | Braun et al. | 123/182 |
| 4,590,905 | 5/1986 | Matsuki et al. | 123/90.17 |
| 4,610,227 | 9/1986 | Nakano et al. | 123/90.16 |
| 4,615,313 | 10/1986 | Tsumiyama | 123/182 |
| 4,651,687 | 3/1987 | Yamashita et al. | 123/90.16 |
| 4,672,930 | 6/1987 | Sumi | 123/90.16 |
| 4,696,266 | 9/1987 | Harada | 123/182 |

*Primary Examiner*—Charles J. Myhre
*Assistant Examiner*—Weilun Lo
*Attorney, Agent, or Firm*—Quarles & Brady

[57] ABSTRACT

An internal combustion engine is provided with a mechanism to release engine compression at low speeds thereby facilitating starting of the engine. The engine has an exhaust valve which is operated by a valve lifter following a cam surface. A cam pin is positioned within a seat in that cam surface in a manner which allows the pin to rotate. A drive member is attached to the cam pin and has gear teeth in a peripheral edge. A flyweight has teeth which engage the gear teeth of the drive member and cause a rotation of the cam pin in response to engine speed. At relatively low engine speeds an eccentric portion of the cam pin extends above the cam surface so as to engage the valve lifter producing an opening of the exhaust valve during the compression portion of the engine cycle. At higher engine speeds the cam pin is rotated so that the eccentric portion of the cam pin no longer extends above the cam surface so that the exhaust valve is not opened during the engine compression. This operation automatically release of the compression at lower engine speeds.

9 Claims, 2 Drawing Sheets

GEARED AUTOMATIC COMPRESSION RELEASE FOR AN INTERNAL COMBUSTION ENGINE

BACKGROUND OF THE INVENTION

The present invention relates to compression release mechanisms for internal combustion engines which operate a valve at low engine speeds to release pressure within the engine cylinder during the compression portion of the combustion cycle.

It is desirable in internal combustion engines to reduce the force required to turn over the engine during starting. It is particularly advantageous to reduce the starting forces in small internal combustion engines which are to be started by hand. In addition, such hand started engines must provide a mechanism to eliminate the danger of physical injury from engine kickback.

The chief cause of difficulty in turning over an internal combustion engine is the engine compression. The prior art is replete with mechanisms for releasing or reducing compression during starting. Early devices provided a manually operated valve which released the pressure from the cylinder during starting. The disadvantage of such a manual valve is that it must be quickly closed by the operator after cranking in order for the engine to start. The manual operated valve requires a certain amount of skill in order to properly start the engine and is susceptible to operator oversight. The prior art also teaches a variety of automatic compression release mechanisms which are governed by the speed of the engine. At low engine speeds the compression release mechanism opens a valve during the compression portion of a combustion cycle. When the speed increases above a given level, the compression release mechanism no longer operates to open the valve during the engine compression.

Many of the prior art devices utilized an existing engine cylinder exhaust valve to release the compression during engine starting. In this type of a device, the compression release mechanism operated in conjunction with the cam shaft on which a valve lifter for the exhaust valve rode. An example of this type of mechanism is shown in U.S. Pat. No. 3,362,390. This device has a crescent shaped flyweight which allows a latching pin to pivot less than 90° into different positions depending upon engine speed. In one position, the latching pin engages a valve lifter raising the lifter from a cam surface during engine compression. In prior mechanisms of this type, the lifter dropped off the pin back onto the cam surface at the end of the compression portion of the engine cycle. This abrupt transition generated additional noise in the engine. Furthermore, the latch pin was not rigidly held by the flyweight in its normal operating position thereby allowing the pin to move back and forth.

SUMMARY OF THE INVENTION

A compression release mechanism is incorporated into an internal combustion engine having an exhaust valve and an associated valve lifter. The valve lifter follows a cam surface on a cam shaft. A cam pin is received within a seat in the cam surface so as to be able to rotate within the seat along the pin's longitudinal axis. The cam pin has a portion eccentric to its longitudinal axis, which portion extends above the cam surface to engage the valve lifter in a first rotational position, and which extends below the cam surface in a second rotational position so as not to engage the valve lifter.

The cam pin is attached to a drive plate which has gear teeth in a peripheral edge.

A drive mechanism is provided which engages the gear teeth of the plate and causes it to rotate in response to engine speed. In the preferred embodiment, the drive means comprises a flyweight pivotally mounted on a timing gear fastened to the cam shaft allowing the flyweight to rotate in a plane that is substantially orthogonal to the cam shaft longitudinal axis. A portion of the flyweight has gear teeth which mesh with the gear teeth of the drive plate.

At low engine speeds, the drive mechanism engages the drive plate to rotate the cam pin into the first rotational position thereby forcing the valve lifter to open the valve during the compression portion of the engine cycle. As the engine speed increases, centrifugal forces acting on the drive mechanism rotate the drive plate and the cam pin into the second rotational position. In this second position the eccentric portion of the cam pin does not engage the valve lifter to open the valve.

A general object of the present invention is to provide a mechanism which automatically releases the compression of an internal combustion engine at low speeds to facilitate starting the engine.

A more specific object is to provide such a compression release mechanism having an eccentric cam pin which is rigidly held in different positions depending upon the speed of the engine. By holding the pin in the different positions, it is not permitted to move from those positions.

Another object of the present invention is to provide a flyweight design which can be manufactured easily without complex metal forming steps.

Yet another object is to provide a mechanism which can be assembled easily.

A further object is that the compression release mechanism incorporate components which can be easily fabricated and assembled.

DESCRIPTION OF THE PREFERRED EMBODIMENT

Figure 1:
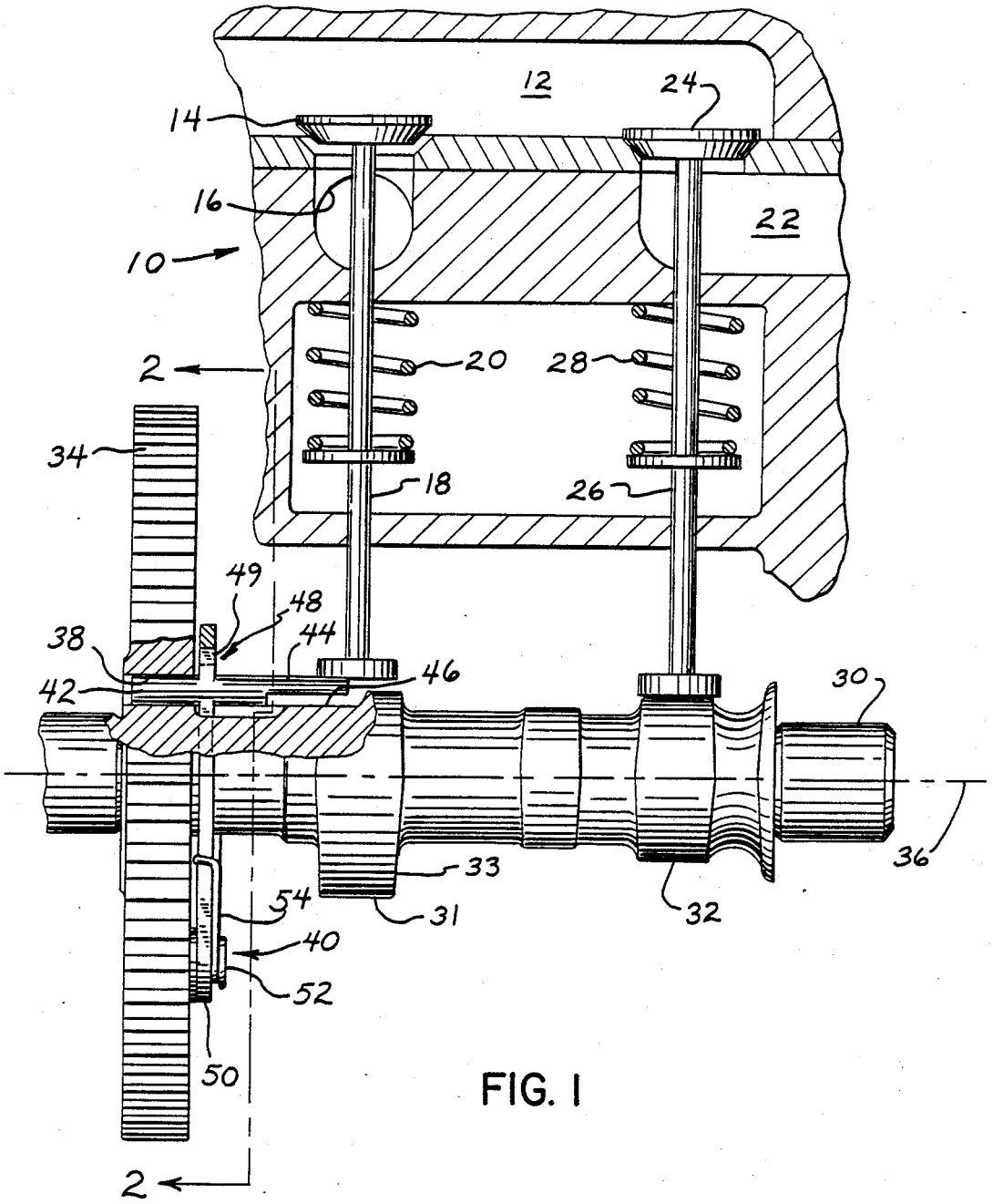
FIG. 1 is a cross sectional view of a portion of an internal combustion engine incorporating the present invention.

With initial reference to FIG. 1, an internal combustion engine 10 has a passage 12 which communicates with the engine cylinder (not shown). The passage 12 opens into an exhaust outlet 16 and has a valve 14 for selectively sealing the interface between the passage and the exhaust outlet. The valve 14 is mounted on a first valve lifter 18 which is biased by spring 20 to maintain the valve in a closed state.

The cylinder passage 12 also communicates with a fuel intake port 22 which connects to a conventional carburetor (not shown). An intake valve 24 selectively seals the interface between the cylinder passage 12 and the fuel intake port 22. The intake valve 24 is attached to a second valve lifter 26 which is biased by spring 28 to maintain the intake valve 24 in a closed position (as illustrated in FIG. 1).

The remote ends of the two valve lifters engage a cam shaft 30 having a longitudinal axis 36. The cam shaft 30 includes a first cam surface 31 which is followed by the first valve lifter 18. The first cam surface 31 has a lobe 33 that pushes the first valve lifter 14 upward to open the exhaust valve 14 when the cam shaft is at a first angular position and release the combustion gases from the engine cylinder. The cam shaft also includes a second cam surface 32 which is followed by the second valve lifter 26 to open the intake valve 24 so that a fuel mixture can enter the cylinder from the carburetor. The operation of the exhaust and intake valves have a conventional timing relationship to the movement of the piston within the engine cylinder. This timing relationship is maintained by a timing gear 34 attached to the cam shaft 30 and meshing with a gear on the piston's crank shaft (not shown).

Figure 2:
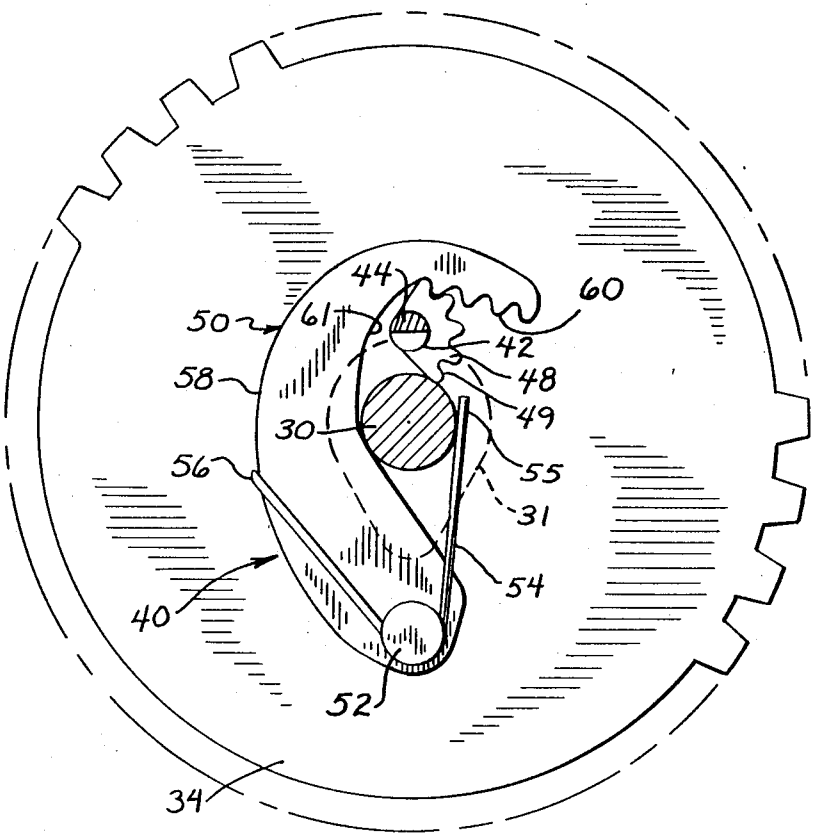
FIG. 2 is a view taken along line 2—2 of FIG. 1 and illustrates the orientation of the components when the engine is stopped or at low speeds.

With reference to FIGS. 1 and 2, the engine 10 further comprises a compression release mechanism, generally designated 40. This compression release mechanism 40 includes a cam pin 42 having an eccentric portion 44 at one end which is received within a seat 46 of the cam shaft 30. The eccentric portion 44 of the cam pin has a semi-circular cross section, as best shown in FIG. 2. The end of the cam pin 42 which is remote from the eccentric portion 44 is located within an aperture 38 in the gear 34. The cam pin 42 loosely fits within the aperture 38 and the cam shaft seat 46 and is able to rotate about the pin's longitudinal axis. A drive plate 48 is fixedly attached to the cam pin 42 and has gear teeth 49 in a peripheral edge.

A generally crescent shaped flyweight 50 is attached to a major surface of the timing gear 34 by a rivet 52 in a manner which allows the flyweight to rotate about the rivet. For example, the flyweight can be stamped from a sheet of metal without the need for further bending. Although the flyweight is attached to a gear in the preferred embodiment, any similar plate-like element fixed to the cam shaft can be used. A torsion spring 54 extends around the rivet 52 with one end 55 in contact with a surface of the cam shaft 30 and another end 56 bent around the outer edge of the flyweight 50 thereby biasing the flyweight 50 toward the cam shaft. The plane of flyweight 50 is substantially parallel to the surface of the gear and normal to the longitudinal axis of the cam shaft 30, as shown in FIG. 1. A series of gear teeth 60 are cut in the inner edge 61 of the flyweight 50 and mesh with the teeth 49 in the drive plate 48. The use of meshed teeth to couple the flyweight and the drive plate facilitates component assembly as compared to previous automatic compression release mechanisms. As will be described in detail, the movement of the flyweight 50 about the rivet 52 exerts a force which produces a rotational movement of the cam pin 42.

FIG. 2 illustrates the orientation of the compression release mechanism 40 when the engine is stopped or at relatively low speed. In this orientation, the torsion spring 54 biases the flyweight 50 toward the cam shaft 30 which rotates the cam pin 42 into an position where its eccentric portion 44 extends above the first cam surface 31 represented by a phantom line. In this position the drive plate 48 strikes the cam shaft 30, which limits the movement of the compression release mechanism 40.

When cam shaft 30 rotates into the angular position illustrated in FIGS. 1 and 2, this eccentric portion 44 engages the first valve lifter 18 forcing it upward thereby opening the exhaust valve 14. The location of the cam pin 42 about the cam shaft 30 is such that this engagement occurs during the compression portion of the combustion cycle. As a consequence, at low engine speeds, for example below approximately 700–800 r.p.m., the eccentric portion 44 of the cam pin 42 will engage the first valve lifter 18 to open the exhaust valve during the compression portion of each combustion cycle. This engagement and opening of the exhaust valve 14 releases the compression within the engine cylinder thereby reducing the amount of force required to turn over the engine. As a result, less force is required to turn over the engine at low engine speeds, such as occur during engine starting.

Figure 3:
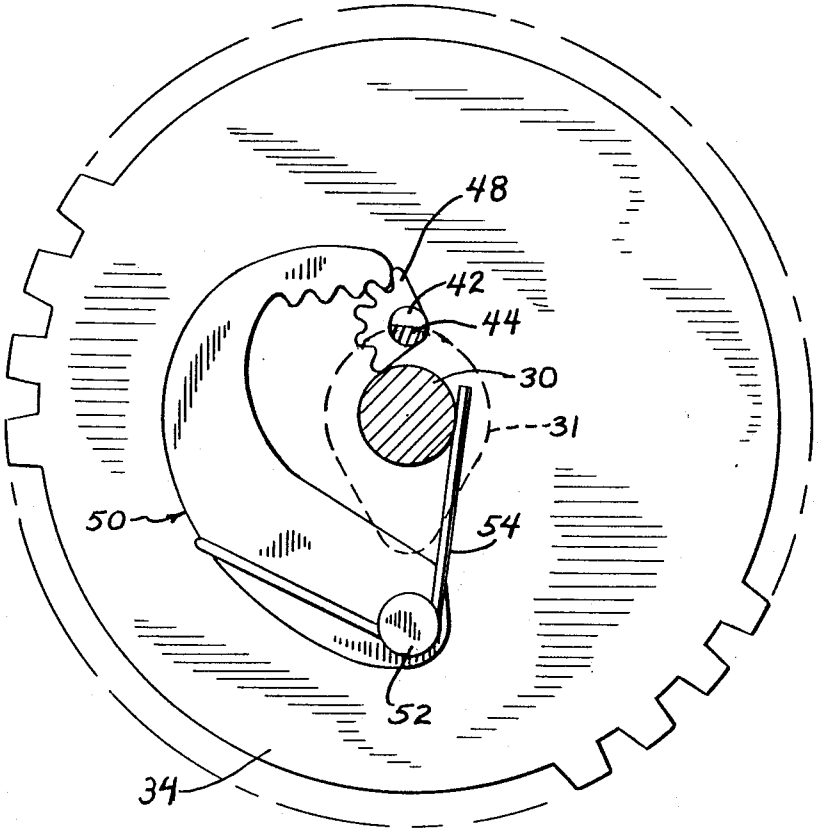
FIG. 3 is an illustration similar to that of FIG. 2, but which illustrates the orientation of the components at a higher engine speed.

As the speed of the engine increases, the centrifugal forces acting on the flyweight 50 exceed the force of the torsion spring 54 causing the flyweight to pivot about rivet 52 away from the cam shaft 30, as illustrated in FIG. 3. As the flyweight 50 pivots, its gear teeth rotate the drive plate 48. The force exerted by the flyweight on the drive plate 48 rotates the cam pin 42 counter clockwise about its longitudinal axis. Above approximately 700–800 r.p.m., the centrifugal forces acting on the flyweight 50 maintain it in the position illustrated in FIG. 3, where the drive plate 48 strikes the cam shaft 30 limiting the outward movement of the flyweight. The speed at which the compression release ceases is set to be slightly greater than the speed at which an electric starter can turn over a warm engine, for example.

When the compression release mechanism is in the orientation illustrated in FIG. 3, the eccentric portion 44 of the cam pin 42 is below the first cam surface 31 depicted by the phantom line. Therefore, as the cam shaft 30 rotates through the compression portion of the combustion cycle, the exhaust valve lifter 18 remains in contact with the first cam surface 31. When the exhaust valve lifter 18 is in contact with this angular portion of the first cam surface 31, it is not raised upward and the exhaust valve 14 remains closed during the compression portion. In this state of operation, the compression within the engine's cylinder is not being released so that at high engine speeds the engine piston is compressing the fuel mixture whereby self-sustained engine operation can occur.

By utilizing gear teeth to transfer the force from the flyweight 50 to the cam pin 42, the cam pin cannot move independently of the flyweight. This provides a smooth controlled rotation of the cam pin from one extreme position of its rotation to the other extreme position (i.e. the positions illustrated in FIGS. 2 and 3). Furthermore, the geared coupling of these elements rigidly holds the cam pin in each of these extreme positions.

Although the present invention has been described in terms of actuating the exhaust valve 14 to release the compression, the intake valve 24 could have been used as a alternative. Even though FIG. 1 illustrates a side valve engine where the valves are locate in the crankcase to one side of the cylinder, the present invention is equally applicable to overhead valve engines in which the valves are located in a cylinder head.

I claim:

1. In an internal combustion engine having a valve, a valve lifter, a cam shaft with a cam surface which engages the valve lifter to open the valve at a first angular position of the cam shaft, and a mechanism for opening the valve at a second angular position of the cam shaft, the improvement in the mechanism comprising:

a cam pin located adjacent to the cam surface in a manner in which said cam pin can rotate on its longitudinal axis, and having a portion eccentric to the longitudinal axis which portion extends above the cam surface to engage the valve lifter and open the valve in a first rotational position and which portion in a second rotational position does not engage the valve lifter in a manner which opens the valve;

a drive member attached to said cam pin and having teeth in one surface thereof; and;

a flyweight which rotates with the cam shaft and having teeth meshed with the teeth of said drive member.

2. The improvement as recited in claim 1 wherein said flyweight is crescent shaped and has the teeth along a concave edge surface.

3. The improvement as recited in claim 1 wherein said cam pin rotates greater than 90 degrees between the first and second rotational positions.

4. The improvement as recited in claim 1 wherein said cam pin is received in a seat in the cam shaft.

5. In an internal combustion engine having a valve, a valve lifter, a cam shaft with a cam surface which is engaged by the valve lifter to open the valve at a first angular position of the cam shaft, a gear mounted to the cam shaft, and a mechanism for opening the valve at a second angular position of the cam shaft, the improvement in the mechanism comprising:

a cam pin located adjacent the cam surface in a manner in which said cam pin can rotate on its longitudinal axis, and having a portion eccentric to the axis which portion extends above the cam surface to engage the valve lifter and open the valve in a first rotational position and which portion in a second rotational position does not extend above the cam surface;

a drive member attached to said cam pin and having teeth in one surface thereof; and a flyweight pivotally mounted to the gear and extending in a plane substantially orthogonal to a longitudinal axis of the cam shaft, said flyweight having teeth which engage the teeth of said drive member.

6. The improvement as recited in claim 5 wherein the eccentric portion of said cam pin is designed so that the valve lifter contacts the cam surface before disengaging contact with the cam pin during each rotation of the cam shaft when the cam pin is in the first rotational position.

7. The improvement as recited in claim 6 wherein said cam pin is received in a seat in the cam shaft.

8. The improvement as recited in claim 5 wherein said flyweight is crescent shaped having a first end pivotally attached to the gear and a second end having the teeth along a concave edge of the flyweight.

9. The improvement as recited in claim 5 wherein said drive member comprises a plate having an aperture in which said cam pin is fixedly received.

* * * * *